US005547321A

United States Patent [19]

Thomas

[11] Patent Number: 5,547,321

[45] Date of Patent: Aug. 20, 1996

[54] COMBINED SIDEWALL AND TIE-DOWN FOR PALLET

[75] Inventor: James D. Thomas, Warren, Mich.

[73] Assignee: The United States of America as represented by the Secretary of the Army, Washington, D.C.

[21] Appl. No.: 521,230

[22] Filed: Aug. 22, 1995

[51] Int. Cl.[6] ..... B60P 7/08; B61D 45/00

[52] U.S. Cl. ..... 410/102; 296/43; 105/390; 410/101; 410/106; 410/110

[58] Field of Search ..... 410/96, 101, 102, 410/106, 110; 296/43; 105/380, 390

[56] References Cited

U.S. PATENT DOCUMENTS

| | | | |
|---|---|---|---|
| 3,421,726 | 1/1969 | Getter | 410/110 |
| 3,595,125 | 7/1991 | Jacobs | 410/106 |
| 4,316,688 | 2/1982 | Roskelley | 410/102 |
| 4,453,761 | 6/1984 | Felburn | 296/43 |
| 4,657,299 | 4/1987 | Mahan | 296/43 X |
| 4,812,093 | 3/1989 | Millar Jr. | 410/110 |
| 5,071,185 | 12/1991 | Schiele | 410/106 X |
| 5,141,277 | 8/1992 | Alexander | 410/110 X |

*Primary Examiner*—Karen B. Merritt

*Assistant Examiner*—Stephen Gordon

*Attorney, Agent, or Firm*—David L. Kuhn; Peter A. Taucher

[57] ABSTRACT

An adaptor assembly for a pallet or platform allows plural cargo carrying configurations for the pallet. The assembly has a pocket at the edge of the pallet's bed, the pocket having opposed sides, a web therebetween facing the edge of the bed and a ledge between the sides. The pocket has a gap between the sides adjacent to and coplanar with the ledge. A clamp passing through the gap has a mediate section faced on the edge, the mediate section opposing the web and contacting the sides of the pocket. First and second legs of the clamp join to the mediate section and bear on opposed sides of the bed, the mediate section and the legs together forming a C-shaped structure closely received on the bed. A flange extends inboard of the pallet from the first leg and provides a cargo tie-down point. The clamp has one position where the flange is above the bed and has an inverted position where the flange is below the bed. The shank of a stake fits closely between the sides of the pocket and closely between the mediate section and the web. The assembly also includes a wall unit comprised of a wall panel faced against the stake and frame members faced to the wall panel along borders thereof, the frame members closely fitting steps in the stake such that the wall panel, stake and frame members mutually reinforce each other.

8 Claims, 4 Drawing Sheets

COMBINED SIDEWALL AND TIE-DOWN FOR PALLET

GOVERNMENT USE

The invention described here may be made, used and licensed by or for the U.S. Government for governmental purposes without paying me royalty.

BACKGROUND AND SUMMARY

The US Army recently fielded a vehicle configured to have a so-called "palletized loading system" wherein the load bed of the vehicle is essentially a huge pallet or flatrack that can be loaded off or on the vehicle as a unit. It is desired for certain cargos that a set of side walls be placed on the load bed's periphery to enclose the cargo. However, such side walls interfere with cable connections between tie downs just outboard of the bed and points inboard of the side walls. Holes in the side walls can address this situation. However problems arise in sufficiently reinforcing the walls and their connection to the bed so as to resist forces exerted by tie-down cables or straps.

I use a new approach in that my invention provides cable attachment points inboard of the side walls. In addition, my invention yields more versatility in reconfiguring a load bed than just adding or deleting side walls.

My invention uses a bed with pockets at the bed's outboard edges, the bottoms of the pockets having gaps. The pockets were not invented by me, but my invention includes passing specially designed clamps through the gaps. Each clamp has a mediate section in the pocket. The mediate section faces on the edge of the bed, contacts the pocket's opposed sides and faces toward the pocket's web. Legs of the clamp join the mediate section, and the legs bear on upper and lower bed surfaces, whereby the mediate section and legs form a "C" on the edge of the bed. A flange of the clamp extends inboard from one leg and has a cable connection point. In the clamp's upright position, the flange is above the bed and in the clamp's inverted position, the flange is below the bed.

My invention also includes stakes that fit into the pockets and provide support for wall units on the bed. Each stake has an upper step, lower step and a shank just below the lower step. The shank fits closely between the sides of the pocket. The shank also fits closely between the clamp's mediate section and the web. Each wall unit rests on one of the legs so that the flange is inboard relative to the wall unit. The wall unit has a panel faced on the stake between the steps, and the wall unit has frame members faced to the wall panel. The frame members closely fit the steps so that the panel, stake and frame members reinforce each other.

DETAILED DESCRIPTION

Figure 1:
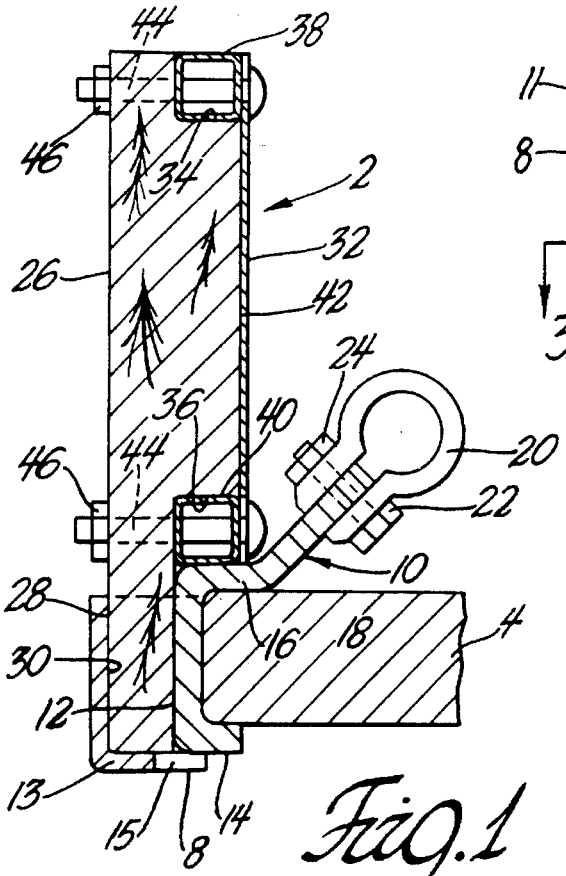
FIG. 1 is a side sectional view of an assembly comprised of a cargo load bed, a pocket on the edge of the bed, a stake in the pocket, a wall unit supported on the stake, and a clamp engaging the pocket, stake and wall unit.
Figure 3:
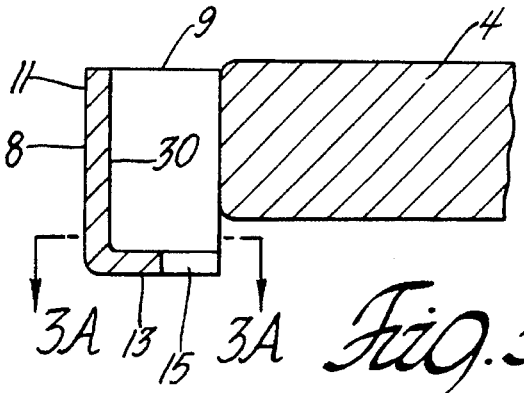
FIG. 3 is a detail view of the pocket with the stake, clamp and wall unit removed.
Figure 3A:
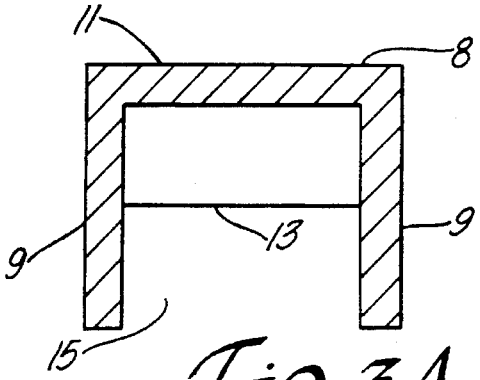
FIG. 3A is a sectional view of the pocket taken along line 3A—3A in FIG. 3.
Figure 2:
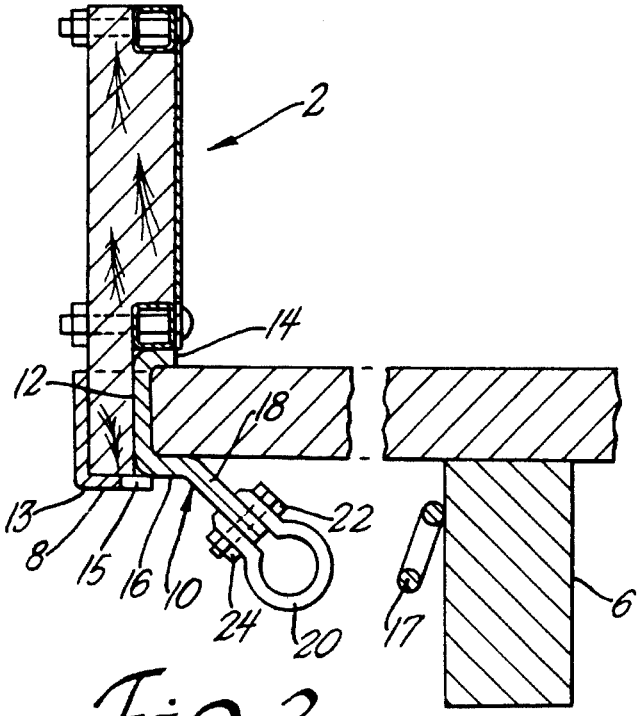
FIG. 2 is the assembly of FIG. 1 wherein the clamp has been inverted.
Figure 4:
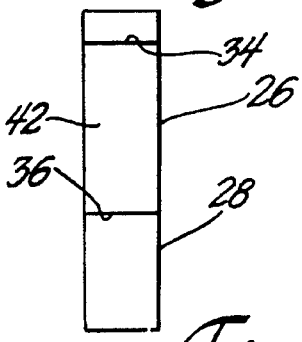
FIG. 4 is a front elevational view of the stake.
Figure 5:
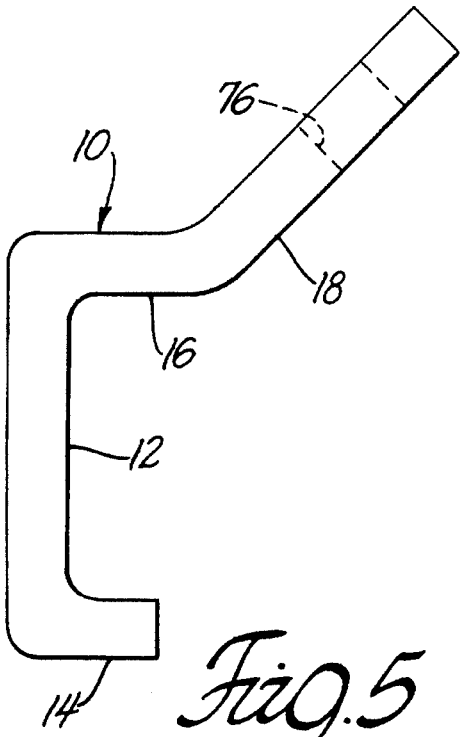
FIG. 5 is a side elevational view of the clamp.

FIGS. 1 and 2 show a load bed 4 of a platform or pallet assembly 2, the bed supported on a conventional rail 6 such that the bed is raised off the ground or other support surface. As perhaps best shown in FIG. 3 and 3A, there is attached to the edge of bed 4 a stake pocket 8 having sides 9, web 11 and ledge 13 at the bottom of the pocket. Adjacent ledge 13 and coplanar therewith is an unbridged bottom gap 15 between opposed sides 9. Gap 15 allows either end of reversible or invertible clamp 10 to pass through pocket 8. A flat, wide mediate section 12 of reversible clamp 10 lies against the edge of bed 4 within pocket 8, mediate section 12 having integrally joined thereto a shorter leg 14 and a longer leg 16. Section 12 and the legs form a generally "C" shaped unit closely fit on the edge of bed 4 so if clamp 10 is placed on bed 4 as in FIGS. 1 or 2, clamp 10 stays on the bed unless disturbed. It may be preferred that the legs interferingly fit to bed 4 so as to squeeze the bed between the legs. A dog-leg flange 18 is integral with longer arm 16. Flange 18 extends upward and inboard of bed 4 in FIG. 1 and has an eye 20 pivotally attached thereto by bolt 22 and nut 24.

A stake 26, typically made of wood, has a shank 28 that slides into pocket 8 so as to bear conformingly against inner surface 30 of the pocket while bearing against mediate section 12, whereby clamp 10 and shank 28 fit closely in pocket 8 between inner surface 30 and the edge of bed 4. When stake 28 is removed from pocket 8, clamp 10 can be reversed from the FIG. 1 position to the FIG. 2 position or vice versa. Otherwise, when stake 26 is in pocket 8, clamp 10 is locked in position. Clamp 10 is put in the FIG. 1 position if a wall unit having panel 32 is placed on bed 4 and a tie-down point such as eye 20 is needed inboard of the wall panel. Clamp 10 is reversed to the FIG. 2 position if an inboard tie-down point is unnecessary and one wishes to remove clamp 10 and eye 20 from the inboard cargo space on bed 4. Optionally, tie ring 17 or a like tie-down mechanism can be welded to rail 6 so that a cable or strap (not shown) can be attached between eye 20 and ring 17 so as to retain stakes, tarps or other objects in storage underneath bed 4. For some instances of cargo loading, it may be preferred to have only the stakes and not wall panel 32 erected about the bed. In these cases, clamp 10 can again be placed in either the FIG. 1 position or the FIG. 2 position, whichever is more desirable. Note in FIG. 2 that clamp 10 and eye 20 do not extend down as far as rail 6, so that the clamp and eye clear the ground in the FIG. 2 position.

Stake 26 defines shoulders or steps 34 and 36 that closely receive frame members 38 and 40 of the wall unit, and inboard surface 42 of stake 26 bears against the outboard surface of panel 32. The stake is thus conformingly received by the wall unit comprised of panel 32 and frame members 38 and 40. Consequently the frame members, wall panel 32 and the stake mutually stiffen and support each other. Panel 32 is preferably releasably attached to the frame members and the stake by bolts 44 and nuts 46 or other suitable mechanical fastener.

Figure 7:
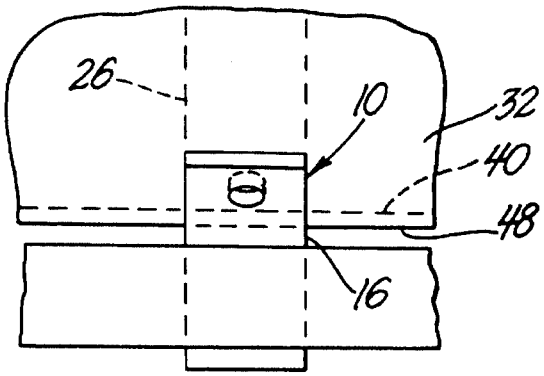
FIG. 7 is a partial front elevational view of the assembly of the bed, clamp wall unit and stake.
Figure 8:
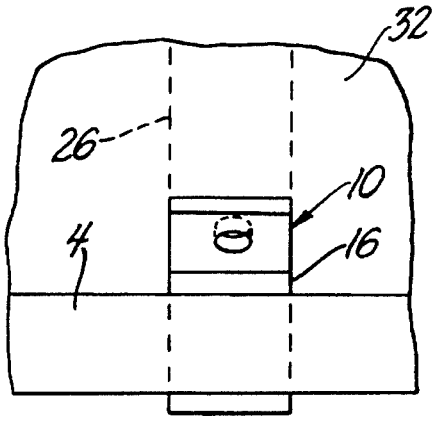
FIG. 8 is a modification of the FIG. 7 assembly.
Figure 9:
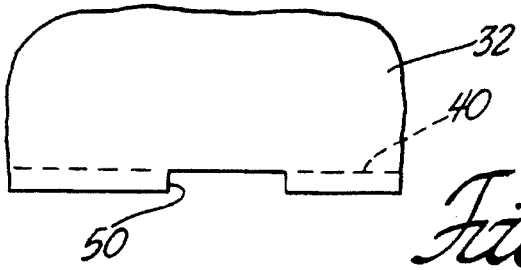
FIG. 9 is the wall unit of the FIG. 8 assembly.

Frame member 40 and the lower border of wall panel 32 normally lie atop leg 16 of clamp 10 in the FIG. 1 position and atop leg 14 in the FIG. 2 position. As can be best seen from FIG. 7, the interposition of longer leg 16 between wall panel 32 and bed 4 creates a narrow gap 48 between panel 32 and bed 4. Shorter leg 14 would create a similar narrow gap if clamp 10 were reversed from the FIG. 7 position. Gap 48 is intended as an outlet mechanism to let water or small items of debris escape from a rectangular enclosure comprised of a set of framed panels such as panel 32 and bed 4. An overhead view of such an enclosure can be seen in FIG. 11. As an option, panel 32 and frame member 40 may be cut to form a notch 50 as seen in FIG. 9, the notch fitting closely over leg 16 as seen in FIG. 8. The advantage of the latter arrangement is that small articles such as hand tools or screws can be placed loose in the aforementioned rectangular enclosure without fear of losing them.

Figure 3B:
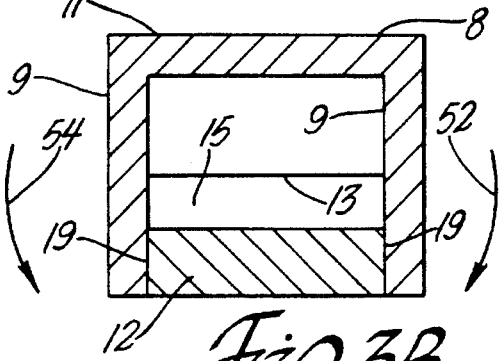
FIG. 3B is the same as FIG. 3A except that a cross section of a mediate section of a clamp has been added.
Figure 6:
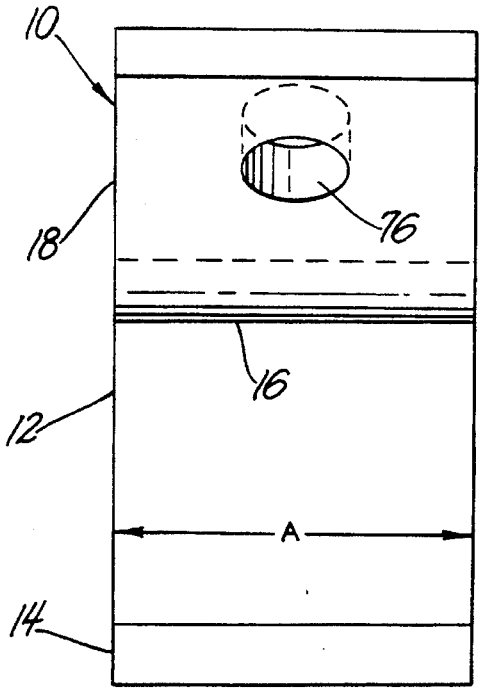
FIG. 6 is a front elevational view of the clamp.
Figure 11:
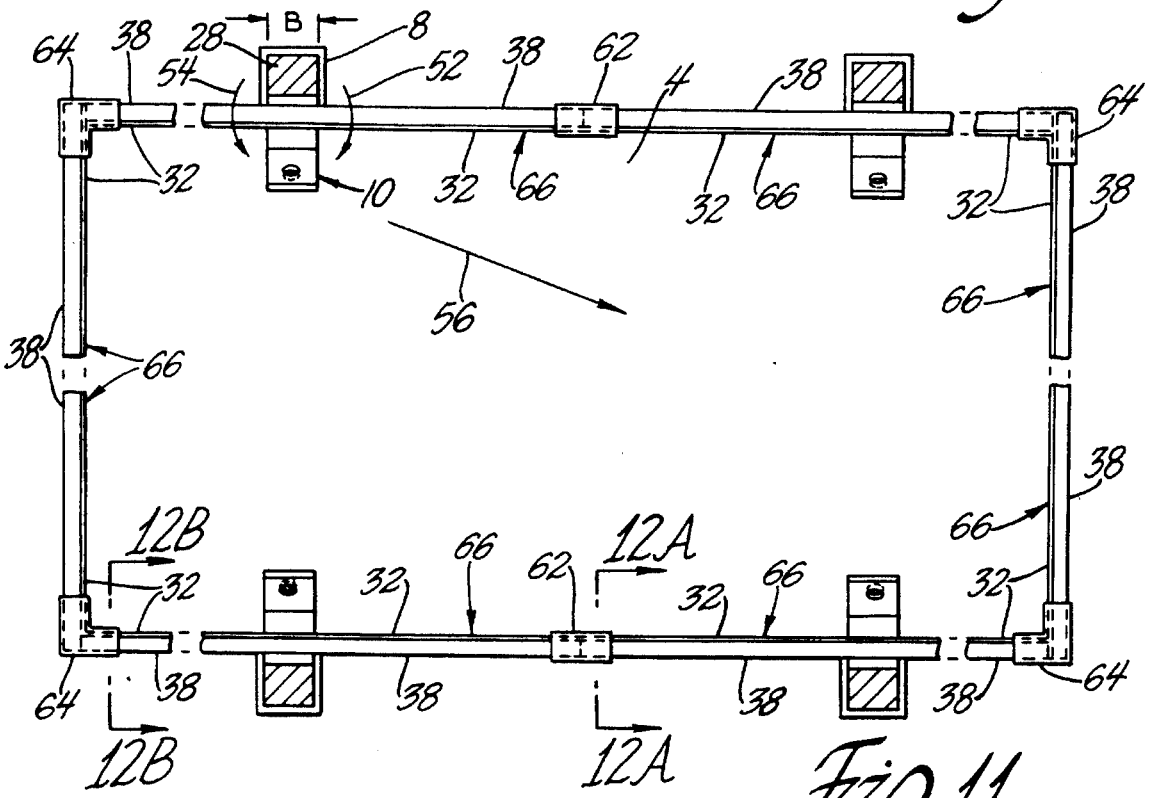
FIG. 11 is a plan view of several wall units, stakes, clamps and pockets arranged to form a rectangular cargo enclosure on a load bed.

As can be seen in FIG. 6, mediate section 12 of clamp 10 has a relatively great width "A" that matches dimension "B" shown in FIG. 11, dimension "B" being both the inside width of pocket 8 and the width of shank 28. Consequently, clamp 10 can not slide along bed 4 or twist in angular directions 52 or 54 without interfering with opposed sides of pocket 8. Note in FIG. 3B that edges 19 of mediate section 12 will interfere with pocket sides 9 should section 12 be rotated in either direction 52 or direction 54. The aforementioned twisting or rotation is further prevented by section 12 being closely fit between bed 4 and shank 28 as seen in FIG. 1. Clamp 10 is thus a stable tie-down point and will not slide or twist, for example when cable tension in direction 56 is exerted on clamp 10 in FIG. 11.

Figure 10:
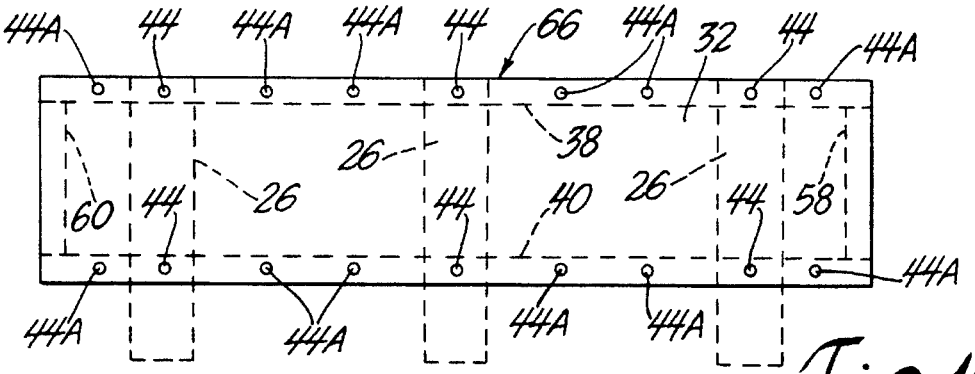
FIG. 10 is a front elevational view of a complete wall unit.

FIG. 10 is an inboard view of an assembly 66 of wall panel 32, frame members therefor and stakes 26. Specifically, horizontal frame members 38 and 40 are connected by vertical frame members 58 and 60 to form a rectangular border fastened at the edges of wall panel 32. A plurality of stakes are attached to panel 32 and to the rectangular border by bolts 44, the stakes spaced at intervals between vertical frame members 58 and 60 so that the stakes act as added vertical frame members for panel 32. Bolt locations 44A are alternate attachment points for stakes 26 on assembly 66.

Figure 12A:
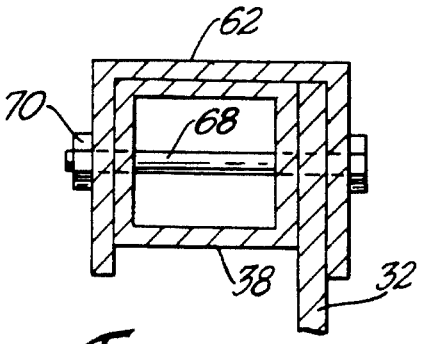
FIG. 12A is a sectional view of a bracket taken along line 12A—12A in FIG. 11.
Figure 12B:
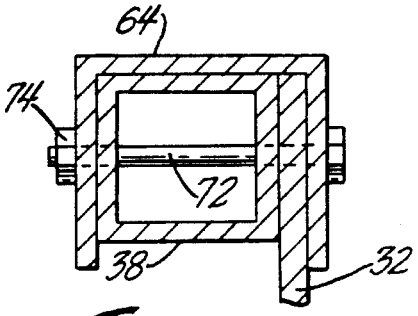
FIG. 12B is a sectional view of a bracket taken along line 12B—12B in FIG. 11.

FIG. 11 is a plan view of several assemblies 66 configured upon bed 4 to form a rectangular enclosure, assemblies 66 being joined together by straight brackets 62 and corner brackets 64. As can be seen in FIGS. 12A and 12B, the brackets have U-shaped cross sections that fit closely over wall panels 32 and frame members 38. The brackets can be fastened to assemblies 66 by bolts 68 or 72 engaged with nuts 70 or 74.

Figure 13:
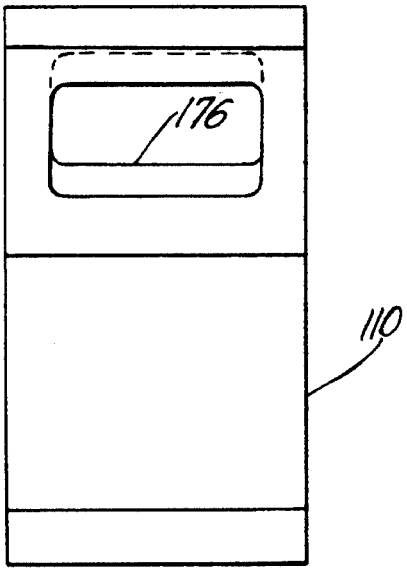
FIG. 13 is a front elevational view of an alternate design for a clamp.
Figure 14:
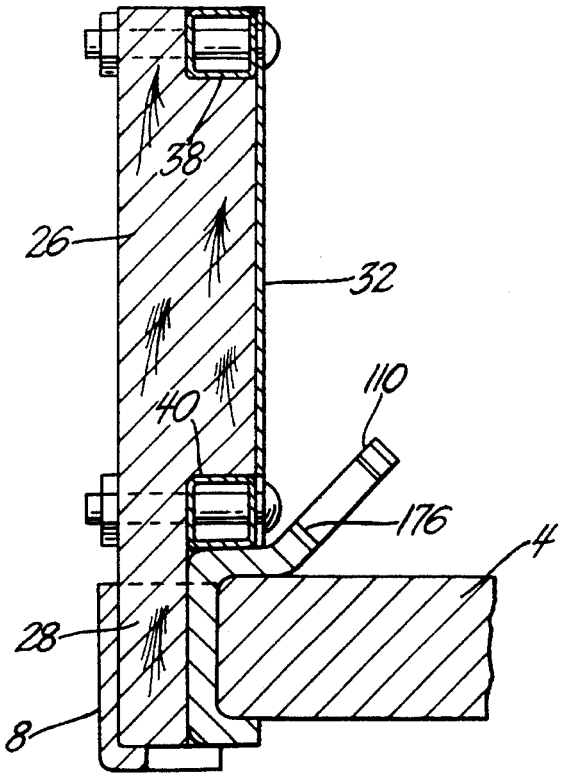
FIG. 14 is a side sectional view of the assembly comprised of the cargo load bed, the pocket on the edge of the bed, the stake in the pocket, a wall unit supported on the stake, and the modified clamp of FIG. 13, the modified clamp engaging the pocket, stake and wall unit.

FIG. 13 shows an alternate embodiment 110 of clamp 10 in FIG. 6, the only difference being that clamp 110 has a rectangular aperture 176 which replaces aperture 76 in FIG. 6. Aperture 176 is large enough to act as a tie down point so that eye 20 is not necessary. FIG. 14 shows clamp 110 installed between shank 28 and bed 4.

Figure 15:
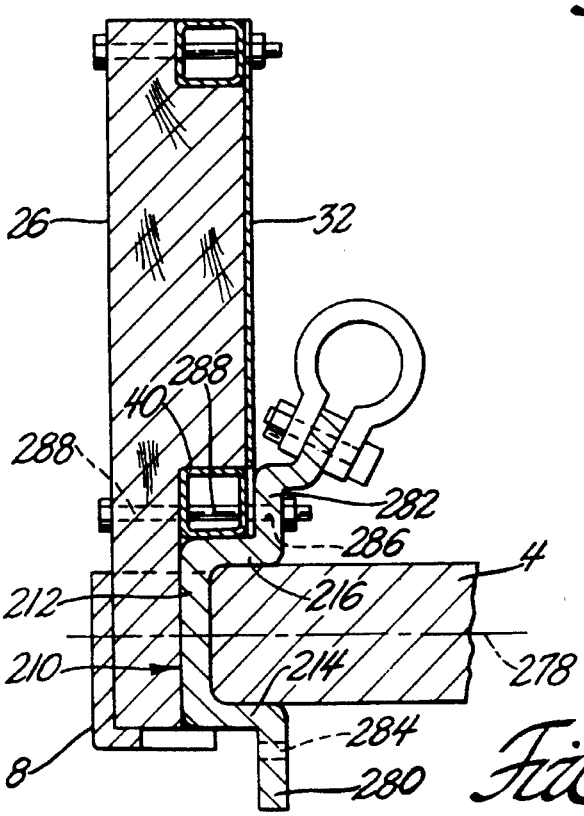
FIG. 15 is another side sectional view of the assembly where a second alternate clamp design is employed.

A still further embodiment 210 of the clamp is shown in FIG. 15, clamp 210 having mediate section 212 similar to section 12 in FIG. 6. Clamp 210 has a first leg 214 and a second leg 216 forming with section 212 a "C" shape fit closely upon the edge of bed 4. Integral with the legs are flanges 280 and 282 whose respective apertures 284 and 286 are equidistant from bed 4. Aperture 286 aligns with bolt 288 passing through stake 26 and frame member 40. It is possible to invert clamp 210 to a new position on bed 4 so that clamp 210 is effectively rotated 180 degrees on axis 278 and aperture 284 aligns with bolt 288. The engagement of stake 26, bolt 288 and flange 282 locks stake 26 with pocket 8, and stake 26 would be likewise locked with pocket 8 if clamp 210 were inverted and aperture 284 engaged bolt 288. Bolt 288 is not only a means to lock stake 26 in pocket 8, it is also a means to fasten panel 32, frame member 40, stake 26 and clamp 10 all together.

I do not desire to be limited to the exact details of construction or method shown herein since obvious modifications will occur to those skilled in the relevant arts without departing from the spirit and scope of the following claims.

What is claimed is:

1. An adaptor assembly for a cargo carrying platform allowing multiple cargo carrying configurations for the platform, the adaptor assembly comprising:

a bed;

a pocket at the edge of the bed, the pocket having opposed sides, a web between the sides facing the bed, a ledge between the sides, the pocket defining an unbridged gap between the sides adjacent the ledge;

a clamp passed through the gap, the clamp having a mediate section facing against the edge, opposing the web and contacting the sides of the pocket;

first and second legs of the clamp joined to the mediate section and bearing on opposed sides of the bed, the mediate section and the legs together forming a C-shaped structure closely received on the bed;

a flange of the clamp extending inboard of the platform from the first leg;

the clamp having a first position wherein the flange lies above the bed and having a second, inverted position wherein the flange lies below the bed;

a stake defining an upper and lower step;

a shank of the stake fitting closely between the sides of the pocket and fitting closely between the mediate section and the web;

a wall unit disposed above one of the legs whereby the flange is inboard of the wall unit, the wall unit comprised of a wall panel faced against the stake at a contact zone of the stake between the steps;

frame members of the wall unit faced to the wall panel along borders of the wall panel, the frame members closely fitting the steps such that the wall panel, stake and frame members mutually reinforce each other.

2. The adaptor assembly of claim 1 further including means for allowing water and debris to escape the platform;

wherein the wall unit is spaced from the bed by one of the legs, whereby a narrow gap is formed between the wall unit and the bed, the narrow gap comprising the allowing means.

3. The adaptor assembly of claim 1 further comprising means for fixing the flange and the stake together, whereby the stake is locked in the pocket.

4. The adaptor assembly of claim 3 wherein the fixing means is also a means to fasten the flange, one of the frame members, the wall panel and the stake together.

5. The adaptor assembly of claim 1 further including means to detachably affix the wall unit to the stake.

6. An adaptor assembly for a cargo platform allowing plural cargo carrying configurations for the platform, the adaptor assembly comprising:

a bed;

a pocket fixed to the bed, the pocket having opposed sides, a web between the sides facing the bed and a ledge between the sides, wherein the pocket defines an unbridged gap between the sides and adjacent the ledge;

a clamp passed through the gap, the clamp having a mediate section facing on the bed, the mediate section opposing the web and contacting the sides of the pocket;

legs of the clamp joined to the mediate section and bearing on opposed sides of the bed, the mediate section and the legs forming a C-shaped structure closely fit on the bed;

a flange of the clamp extending inward of the bed from one of the legs;

the clamp having a first position wherein the flange lies above the bed and having a second, inverted position wherein the flange lies below the bed;

a shank fitting closely between the sides of the pocket and fitting closely between the mediate section and the web.

7. The adaptor assembly of claim 6 further comprising:

a stake of which the shank is part;

means for fixing the flange to the stake.

8. An adaptor assembly for a cargo platform allowing multiple cargo carrying configurations for the platform, the adaptor assembly comprising:

a bed;

a pocket fixed to an edge of the bed, the pocket having two opposed sides, a web between the sides facing toward the edge, a ledge between the sides facing up, the pocket defining at its bottom a gap between the sides coplanar with the ledge;

a clamp passed through the gap, the clamp having a flat, wide mediate section facing against the edge, opposing the web and contacting the sides of the pocket;

first and second legs of the clamp joined to the mediate section and bearing on opposed sides of the bed so that the mediate section and the legs together form a C-shaped structure closely received on the bed;

a flange of the clamp extending inboard of the bed from the first leg, the flange defining an aperture;

the clamp having a first position wherein the flange lies above the bed and having a second, inverted position wherein the flange lies below the bed;

a shank fitting closely between the sides of the pocket and fitting closely between the mediate section and the web.

* * * * *